US007433620B2

(12) United States Patent
Sekiguchi et al.

(10) Patent No.: US 7,433,620 B2
(45) Date of Patent: Oct. 7, 2008

(54) IMAGE FORMING APPARATUS WITH CONTROLLED ELECTRIC POWER SUPPLY TO HEATING MEMBER

(75) Inventors: Nobuo Sekiguchi, Moriya (JP); Katsuhide Koga, Moriya (JP); Kenji Kuroki, Toride (JP); Jun Nakazato, Toride (JP); Tomoichiro Ohta, Kashiwa (JP); Yoshitaka Yamazaki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/177,283

(22) Filed: Jul. 11, 2005

(65) Prior Publication Data

US 2006/0018678 A1 Jan. 26, 2006

(30) Foreign Application Priority Data

Jul. 13, 2004 (JP) ..... 2004-205847

(51) Int. Cl.
*G03G 15/20* (2006.01)

(52) U.S. Cl. ..... 399/70

(58) Field of Classification Search ..... 399/67–70, 399/88

See application file for complete search history.

(56) References Cited

U.S. PATENT DOCUMENTS

| | | | | |
|---|---|---|---|---|
| 5,942,882 | A | 8/1999 | Ohta | 323/282 |
| 6,115,510 | A | 9/2000 | Koga | 382/309 |
| 6,181,905 | B1 | 1/2001 | Ohta et al. | 399/328 |
| 6,188,054 | B1 | 2/2001 | Ohta | 219/663 |
| 6,308,947 | B1 | 10/2001 | Kojima et al. | 271/124 |
| 6,349,187 | B2 * | 2/2002 | Hayashi | 399/70 |
| 6,393,232 | B1 | 5/2002 | Osari et al. | 399/82 |
| 6,502,816 | B2 | 1/2003 | Inoue et al. | 271/121 |
| 6,526,251 | B1 | 2/2003 | Otsuka et al. | 399/313 |
| 6,611,670 | B2 * | 8/2003 | Chen et al. | 399/328 |
| 6,691,399 | B1 | 2/2004 | Hayashi et al. | 29/605 |
| 6,933,480 | B2 | 8/2005 | Ohta | 219/635 |
| 6,959,158 | B2 | 10/2005 | Ohta | 399/69 |
| 6,987,251 | B2 | 1/2006 | Fukushi et al. | 219/619 |
| 7,030,345 | B2 | 4/2006 | Nishihara et al. | 219/619 |
| 7,039,336 | B2 | 5/2006 | Ohta | 399/69 |
| 7,053,345 | B2 | 5/2006 | Fukushi et al. | 219/619 |
| 7,106,987 | B2 | 9/2006 | Ohta | 399/69 |
| 2004/0202490 | A1 * | 10/2004 | Okamoto | 399/69 |
| 2005/0220466 | A1 | 10/2005 | Takahashi et al. | 399/45 |

(Continued)

FOREIGN PATENT DOCUMENTS

| | | |
|---|---|---|
| JP | 5-87844 | 11/1993 |

(Continued)

OTHER PUBLICATIONS

Abstract of Japanese Patent JP 2005258347 A.*

*Primary Examiner*—Ryan Gleitz
(74) *Attorney, Agent, or Firm*—Fitzpatrick, Cella, Harper & Scinto

(57) ABSTRACT

An image forming apparatus including a fixing device for fixing by heat an image formed on a recording material; a heater for heating the fixing device; a controller for controlling electric power supply to the heater, wherein the apparatus is operable in a stand-by mode in which an electric energy consumption of the heater is reduced, wherein in the stand-by mode, the controller continuously supplies the electric power to the heater.

5 Claims, 12 Drawing Sheets

U.S. PATENT DOCUMENTS

| | | | | |
|---|---|---|---|---|
| 2005/0220467 | A1 | 10/2005 | Takahashi et al. | 399/45 |
| 2005/0249511 | A1 | 11/2005 | Sekiguchi et al. | 399/20 |
| 2006/0018678 | A1 | 1/2006 | Sekiguchi et al. | 399/70 |
| 2006/0024072 | A1 | 2/2006 | Kuorki et al. | 399/33 |
| 2006/0024078 | A1* | 2/2006 | Matsusaka | 399/88 |
| 2006/0083528 | A1 | 4/2006 | Mori et al. | 399/67 |
| 2006/0131301 | A1 | 6/2006 | Ohta et al. | 219/619 |
| 2006/0157475 | A1 | 7/2006 | Nishihara et al. | 219/619 |

FOREIGN PATENT DOCUMENTS

| | | |
|---|---|---|
| JP | 6-332338 | 12/1994 |
| JP | 7-98553 | 4/1995 |
| JP | 2003-266878 | 9/2003 |

* cited by examiner (a)

| SAVING MODE | NO RESET TIME | -10% | -20% | -50% |
|---|---|---|---|---|
| ID | 0 | 1 | 2 | 3 |
| TAGET TEMP. | 200℃ | 175℃ | 150℃ | 120℃ |

(b)

| SAVING MODE | NO RESET TIME | -10% | -20% | -50% |
|---|---|---|---|---|
| ID | 0 | 1 | 2 | 3 |
| VOLT | Vc1 | Vc2 | Vc3 | Vc4 |
| PWR | 300W | 270W | 240W | 150W |

FIG.8

| SAVING MODE | NO RESET TIME | -10% | -20% | -50% |
|---|---|---|---|---|
| ID | 0 | 1 | 2 | 3 |
| REF. VOL | Vc1 | Vc2 | Vc3 | Vc4 |
| REF. PWR | 300W | 270W | 240W | 150W |
| TARGET TEMP. | 200℃ | 180℃ | 150℃ | 110℃ |
| UL TEMP. | 210℃ | 190℃ | 170℃ | 130℃ |
| LL TEMP. | 190℃ | 170℃ | 130℃ | 100℃ |
| UL VOL | Vmax1 | Vmax2 | Vmax3 | Vmax4 |
| LL VOL | Vmin1 | Vmin2 | Vmin3 | Vmin4 |
| UL PWR | 320W | 280W | 255W | 200W |
| LL PWR | 280W | 255W | 200W | 130W |

FIG.11

IMAGE FORMING APPARATUS WITH CONTROLLED ELECTRIC POWER SUPPLY TO HEATING MEMBER

FIELD OF THE INVENTION AND RELATED ART

The present invention relates to an image forming apparatus employing one of the electrophotographic or electrostatic recording methods. In particular, it relates to an image forming apparatus such as a copying machine, a printer, a facsimileing machine, or the like.

It is quite common that an image forming apparatus is provided with multiple electric power saving modes, in which the electric power consumption by the fixing device of the image forming apparatus is substantially reduced while the image forming apparatus is kept on standby. In the power saving modes in accordance with the prior art, the electric power consumption of the fixing device per unit time is reduced by controlling the supply of electric power to the fixation heater of the fixing device, by repeatedly turning on and off the power supply to the fixing device according to the temperature level proportional to the preset rate of reduction in electric power consumption.

More specifically, the voltage supplied to the fixation heater to keep the surface temperature of the heating roller at each of the target temperature levels 710-713 shown in FIG. 7 is kept at the highest level. In other words, the power supply to the fixation heater is repeatedly turned on and off, with the amount of power consumption by the fixation heater kept at the maximum level (800 W) while the power supply is on.

However, repeatedly turning on or off the power supply to the fixation heater generates rush current. In other words, each time the power supply to the fixation heater is turned on or off, rush current is generated, sometimes overloading the commercial power source. Thus, using an image forming apparatus such as the above described one in an office or the like causes such a problem as the flickering of fluorescent lights or the like.

Therefore, it has been a common practice to provide a protective circuit for suppressing rush current, or carrying out a complicated power supply control, or the like, which resulted in increase in apparatus cost, complicated the apparatus control, or created the like problems.

SUMMARY OF THE INVENTION

The primary object of the present invention is to provide an image forming apparatus in which rush current does not occur when the image forming apparatus is in the standby mode in which the electric power consumption by the heating means is kept substantially smaller.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 4(*b*) is a diagram of the rectangular waveform into which the waveform of the alternating voltage applied to the voltage conversion circuit is changed.

FIG. 4(*c*) is a diagram of the waveform of the voltage supplied to the fixation heater in proportion to the rate of the reduction in the amount of electric power supply.

FIG. 8(*a*) is a temperature control table for the power saving mode in accordance with the prior art, and FIG. 8(*b*) is a temperature control table for the power saving mode in the first embodiment of the present invention.

FIG. 11 is a table showing the relationship between the temperature levels and electric power consumed in the second embodiment of the present invention.

DETAILED DESCRIPTION OF THE PREFERRED EMBODIMENTS

Hereinafter, the preferred embodiments of the present invention will be described in detail with reference to the appended drawings. However, the measurements, materials, and shapes of the structural components in the following embodiments of the present invention, the positional relationship among them, their functions, etc., are not intended to limit the scope of the present invention, unless specifically noted. If a given structural component in one of the following embodiments of the present invention has the same referential symbol as the one given to one of the structural components in the preceding embodiments, the two components are identical in material, shape, and function unless specifically noted.

Embodiment 1

(Image Forming Apparatus)

Figure 3:
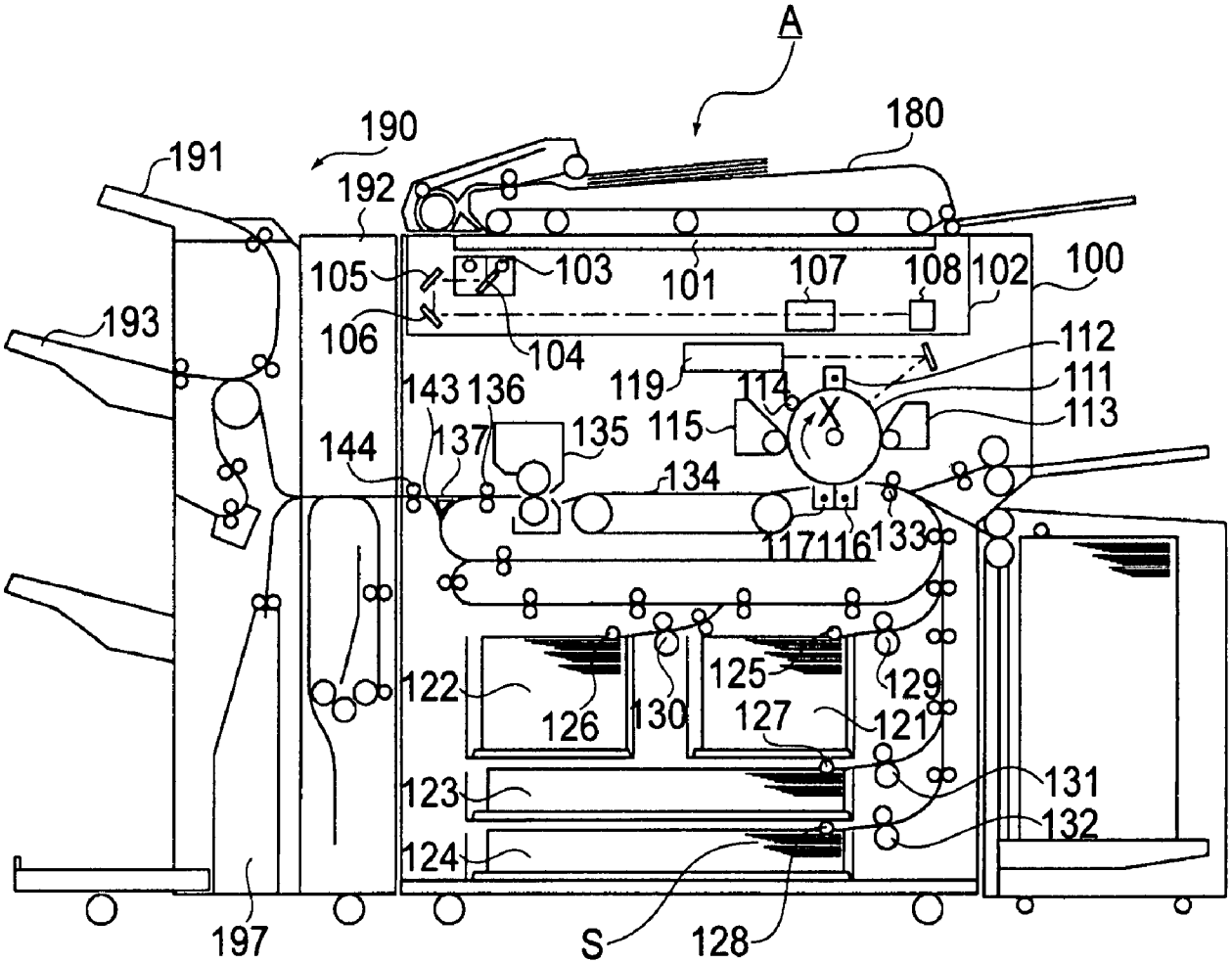
FIG. 3 is a schematic sectional view of the image forming apparatus in the first embodiment of the present invention.

First, an example of a typical image forming apparatus compatible with the present invention will be described regarding its general structure. FIG. 3 is a sectional view of the image forming apparatus in this embodiment.

The image forming apparatus A in this embodiment is a copying machine, the essential components of which are a reader 102, a printer 100, and document feed apparatus 180 (DF) for conveying an original. However, the choice of an image forming apparatus to which the present invention is applicable is not limited to the image forming apparatus A in this embodiment. For example, the present invention is also compatible with a printer alone.

A post-processing apparatus 190 is an apparatus used in conjunction with the image forming apparatus A, and is made up of an apparatus 191 for processing the discharged (recorded) recording mediums, a Z-folding apparatus 192, and a binding machine 197.

The reader 102 is made up of a glass platen 101 as a table for supporting an original, a lamp 103 for illuminating an original, a scanning mirror 104, etc. As for the operation of the reader 102, the original illuminating lamp 103 and scanning mirror 104 are reciprocally moved in a predetermined direction to scan the surface of the original, and the light reflected by the surface of the original is reflected by the scanning mirror 104 and deflection mirrors 105 and 106, and is transmitted through a lens 107 so that an optical image of the original is formed on the CCD sensor in an image sensor portion 108.

An exposure control portion 119 projects a beam of laser light while modulating it with video signals obtained by subjecting the electrical signals resulting from the formation of the optical image on the (charge-coupled device) CCD sensor in the image sensor portion 108, to a predetermined image formation process which will be described later.

In the adjacencies of the peripheral surface of a photosensitive drum 111, a primary charging device 112, a developing device 113, a transfer charging device 116, a pre-exposure lamp 114, and a cleaning apparatus 115 are disposed. Various processes are carried out in the image formation portions located between the peripheral surface of the photosensitive drum 111 and each of the abovementioned components to form an image of toner, on a sheet S of recording medium (which hereinafter may be referred to as recording sheet S). In other words, the printing portion is provided with various image forming devices (means) for forming an image of toner, on the recording sheet S.

The photosensitive drum 111 is rotated by an unshown motor in the direction indicated by an arrow mark X in FIG. 3. While the photosensitive drum 111 is rotated, the peripheral surface of the photosensitive drum 111 is charged by the primary charging device 112 to a predetermined potential level. Then, the charged portion of the peripheral surface of the photosensitive drum 111 is exposed to a beam of laser light projected by the exposure control portion 119. As a result, an electrostatic latent image is formed on the peripheral surface of the photosensitive drum 111. The electrostatic latent image is developed by the developing device 113 into a visible image, that is, an image formed of toner (which hereinafter will be referred to simply as toner image).

Meanwhile, a single or plural sheets S of recording medium (transfer sheet), such as paper, OHP sheet, etc., across which an image is recordable, are fed into the main assembly of the image forming apparatus A from a right-hand cassette deck 121, a left-hand cassette deck 122, a top rack cassette 123, or a bottom rack cassette 124 by pickup rollers 125, 126, 127, and 128, respectively, and then, are conveyed toward a pair of registration rollers 133. Then, each recording sheet S is conveyed by the registration rollers 133 to the image transfer portion which is between the photosensitive drum 111 and transfer charging device 116, and in which the toner image, that is, the visualized electrostatic latent image, on the peripheral surface of the photosensitive drum 111 is transferred onto the recording sheet S by the transfer charging device 116.

After the transfer of the toner image, the peripheral surface of the photosensitive drum 111 is cleared of the residual toner by the cleaning apparatus 115, and its residual electrical charge is erased by the pre-exposure lamp 114. As for the recording sheet S onto which the toner image has just been transferred, it is separated from the photosensitive drum 111 by the separation charging device 117, and is sent to a fixing apparatus 135 by a transfer belt 134.

In the fixing apparatus 135, the toner image on the recording sheet S is thermally fixed to the recording sheet S. Then, the recording sheet S is discharged from the printer 100 by a pair of sheet discharge rollers 136 and a pair of sheet discharge rollers 144. Then, the discharged recording sheet S is conveyed to the post-processing apparatus 190.

The apparatus 191 for processing the discharged recording sheets S, which constitutes a part of the post-processing apparatus 190, is an apparatus for aligning the recording sheets S discharged from the printer 100, and binding them; as each recording sheet S is discharged into a delivery tray 192 and is aligned with the recording sheets in the delivery tray 192.

Figure 2:
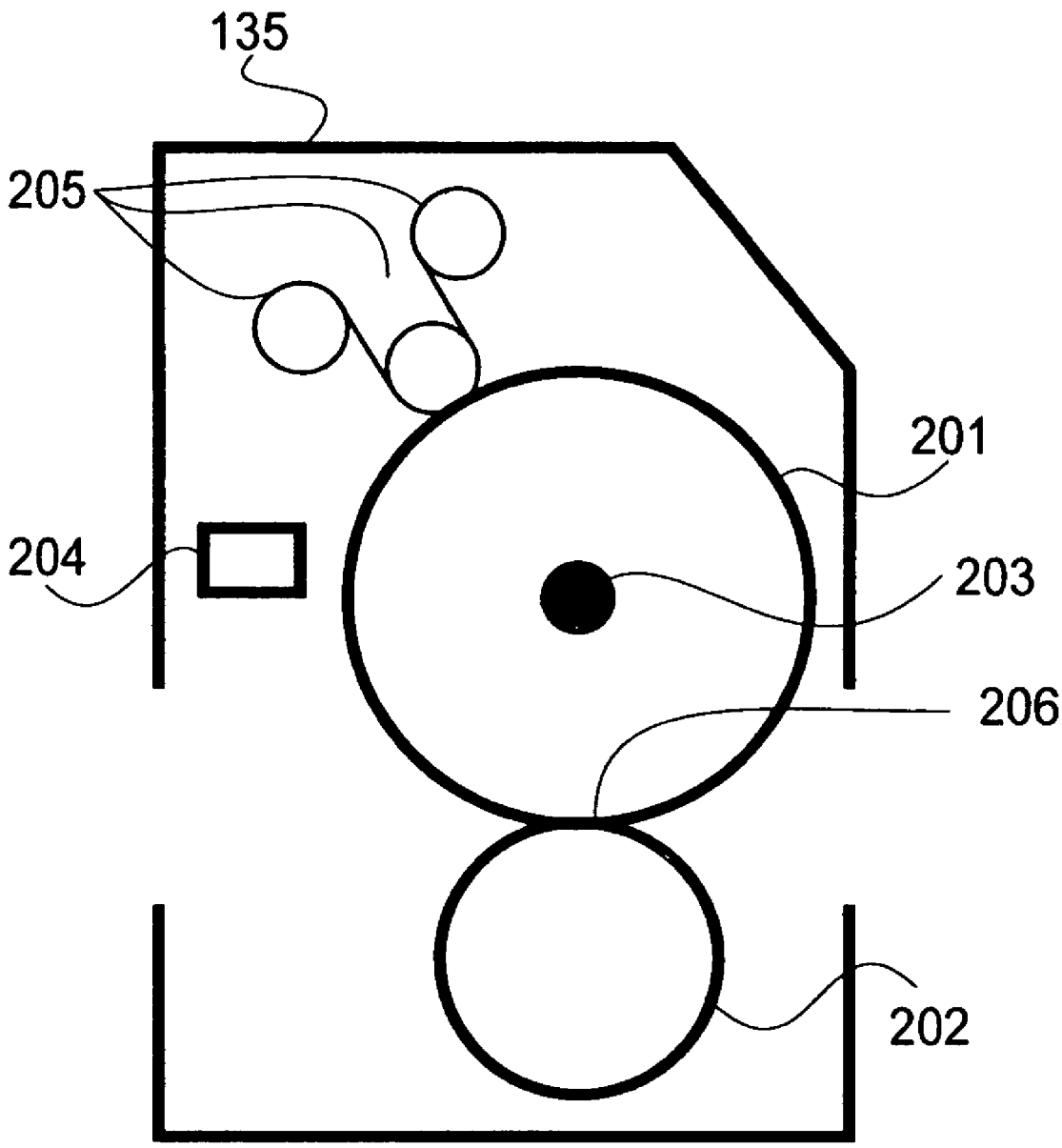
FIG. 2 is a schematic sectional view of the fixing apparatus in the first embodiment of the present invention.

FIG. 2 is a schematic sectional view of the fixing apparatus in this embodiment, showing the general structure thereof.

The fixing apparatus 135 is made up of a heating roller 201 as a fixing means, a pressure roller 202, a halogen heater 203 as a heating means, a temperature detection element 204 as a temperature detecting means, a cleaning web 205, etc.

As for the fixing means, it is possible to employ, as appropriate, a fixing means in the form of an endless film, instead of such a rotational member as the abovementioned heating roller.

As for the means for heating (generating heat in) the fixing means, it is possible to employ, as appropriate, a ceramic heater, a carbon heater made up of a component formed of carbon or the like, an excitation heater which heats the fixing means through electromagnetic induction with the use of a high frequency power supply, etc., instead of the abovementioned halogen heater. In other words, any of various heating means of the contact or noncontact type may be employed as appropriate.

The function of the heating roller 201 is to fix a toner image to the sheet S of recording medium. It is heated by driving the fixation heater 203 in the heating roller 201, with the use of a circuit which will be described later.

The pressure roller 202 is disposed so that it is kept pressed on the heating roller 201. The interface between the heating roller 201 and pressure roller 202 is called nip 206. In the nip 206, the toner image on the recording sheet S, which is yet to be fixed, is fixed to the recording sheet S as it is subjected to the heat and pressure applied thereto. The recording sheet S is made to enter the nip 206 from the right-hand side of the nip 206.

Figure 1:
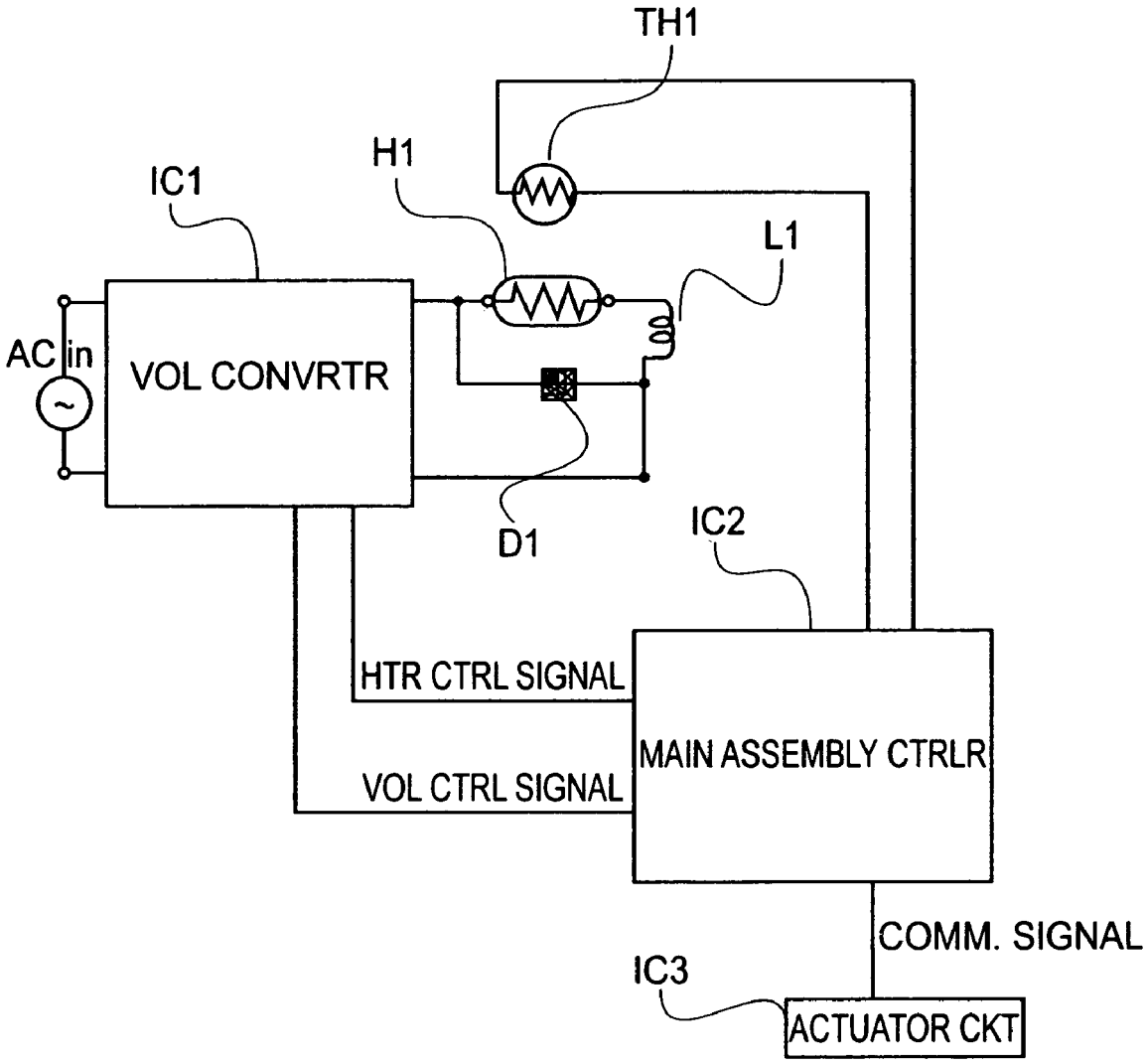
FIG. 1 is a diagram of an electrical circuit which constitutes a part of the means for controlling the fixing apparatus.

The temperature detection element 204 is connected to the electrical circuit shown in FIG. 1, and detects the surface temperature of the heating roller 201. The electrical circuit will be described later.

In the nip 206, pressure and heat is applied to the toner image on the recording sheet S to fix the toner image to the recording sheet S. Therefore, a certain amount of the toner transfers from the toner image onto the heating roller 201, across the areas which correspond in position to the toner image on the recording sheet S. The cleaning web 205 clears these areas of this toner which has adhered to the heating roller 201 through the above described process.

FIG. 1 is a diagram of the electrical circuit which constitutes a part of the means for controlling the fixing apparatus shown in FIG. 2.

In FIG. 1, an inductance L1 smooths out the electric current flowed to the fixation heater H1, that is, an electrical load. The flywheel diode D1 regenerates the electric power stored in the inductance L1. The fixation heater H1 heats the heating roller 201 as the object to be heated. The temperature detection element TH1 is equivalent to the temperature detection element 204 shown in FIG. 2, and thermally, it is in connection with the fixation heater H1. The output of the temperature detection element TH1 is inputted into a main assembly control circuit IC2.

The main assembly control circuit IC2 is a circuit that controls the main assembly of the image forming apparatus A. It is made up of a central processing unit (CPU), ROMS, RAMs, etc. Not only does it control the driving of the fixation heater shown in FIG. 1, but also, the driving of the various apparatuses (load sources) of the main assembly of the image forming apparatus A, shown in FIG. 3.

The output of the temperature detection element TH1 which is equivalent to the temperature detection element 204 of the fixing apparatus 135 is inputted into the main assembly control circuit IC2.

Further, the main assembly control circuit IC2 controls the temperature of the heating roller, in response to the signals outputted from the control panel circuit IC3, based on the values set for the operational variables through the control panel 500 (FIG. 5) as a control value setting means, as will be described later. Thus, a voltage control signal outputted from the main assembly control circuit IC2 is inputted into the voltage conversion circuit IC1. Here, temperature control means keeping constant the temperature of the heating roller 201 of the fixing apparatus 135 at a predetermined level (target level), and the temperature level at which the temperature of the heating roller 201 is kept is the abovementioned predetermined level (target level).

The voltage conversion circuit IC1 is the means for driving the fixation heater. Not only does it convert the alternating current voltage from a commercial power source into direct current voltage, but also varies in steps the direct current voltage in magnitude.

Figure 4:
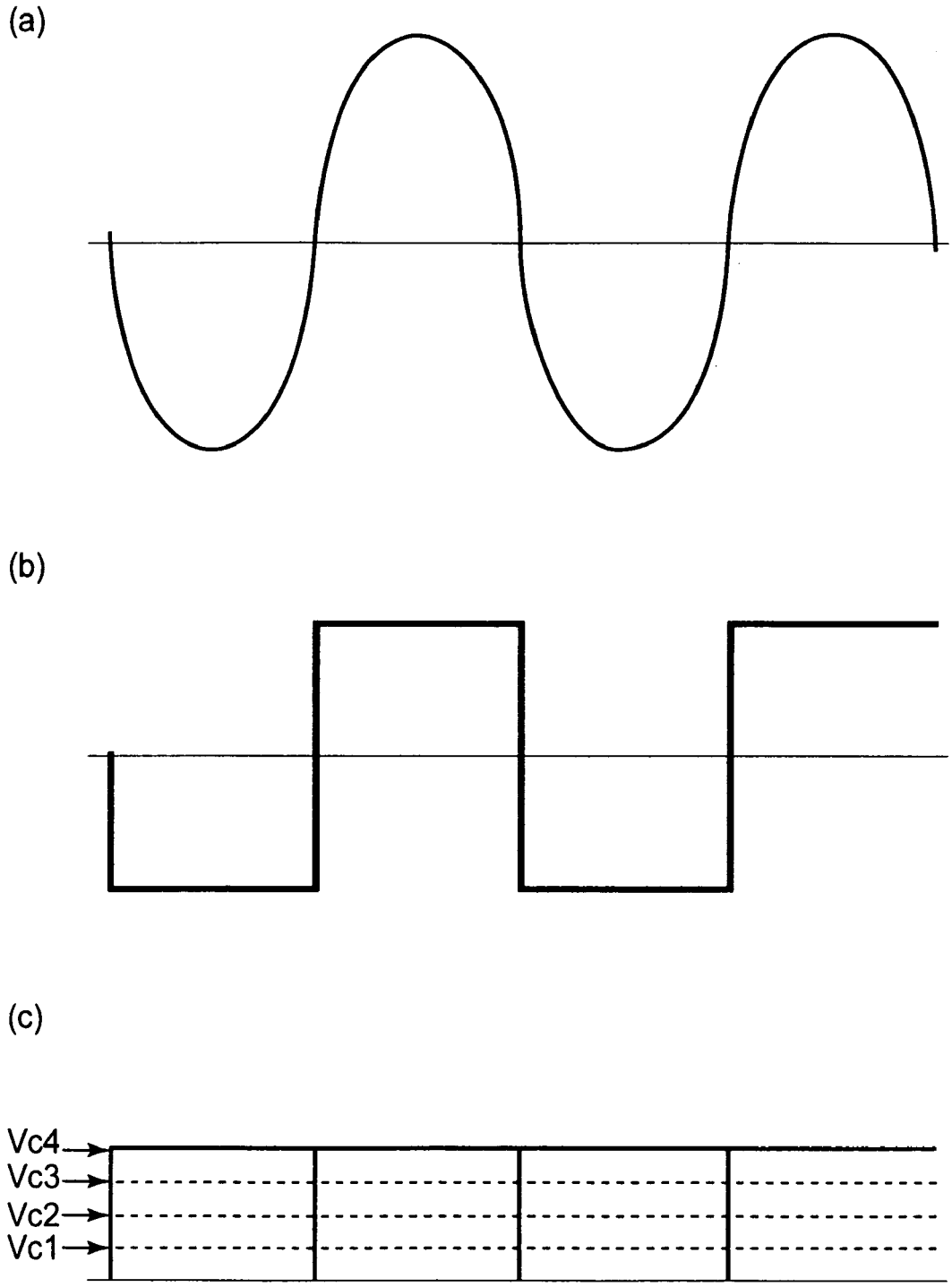
FIG. 4(*a*) is a diagram of the waveform of the alternating voltage applied to the voltage conversion circuit.

FIGS. 4(*a*), 4(*b*), and 4(*c*) are a diagram of the waveform of the alternating current voltage applied to the voltage conversion circuit in this embodiment, from a commercial electrical power source, a diagram of the rectangular waveform into which the sinusoidal waveform of the alternating current voltage applied to the voltage conversion circuit from the commercial electrical power source is changed, and a diagram of the waveform of the direct current voltage into which the alternating current voltage, which is rectangular in waveform, is converted according to the value of the control signal for controlling the fixation heater.

The voltage conversion circuit IC1 converts the alternating current voltage shown in FIG. 4(1), into the alternating current voltage which is rectangular in waveform as shown in FIG. 4(2). Then, it outputs direct current voltage, the magnitude of which equals one of the voltage levels (Vc1-Vc4) shown in FIG. 4(3), which match the values of the control signals, one for one. This direct current voltage is supplied to the fixation heater H1.

Figure 5:
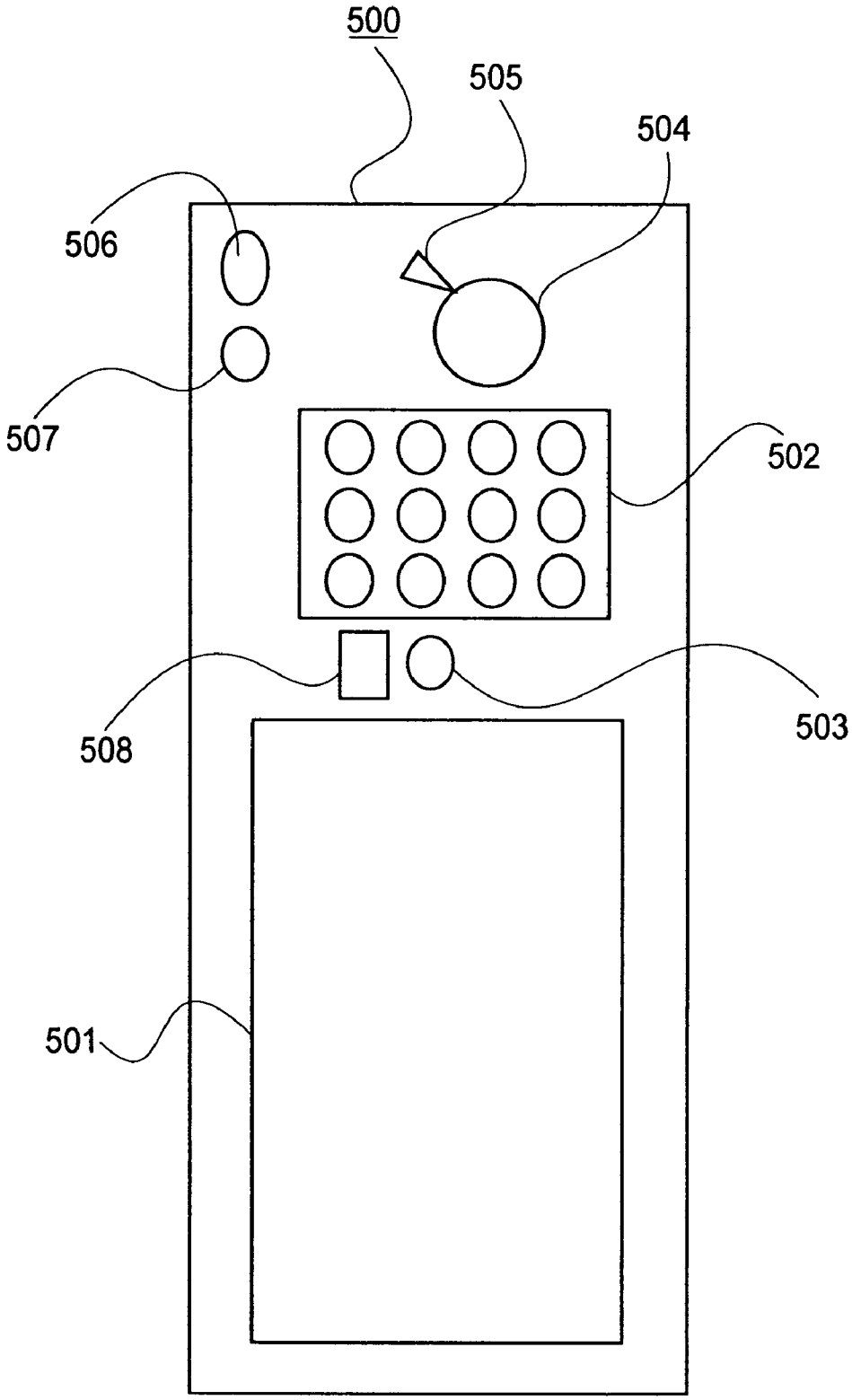
FIG. 5 is a top plan view of the control panel portion of the image forming apparatus in the first embodiment of the present invention.

FIG. 5 is a top plan view of the control panel portion 500 as the means for setting values for controlling the image forming apparatus A in this embodiment. The control panel 500 comprises the control panel circuit IC3 shown in FIG. 1.

The display portion 501 is an LCD of the so-called touch panel type, which is used for selecting one of the operational modes of the image formation system comprising the image forming apparatus A and post-processing apparatus 190, and also, for displaying the conditions of the system. A key pad portion 502 with ten keys has nine numerical keys for inputting numbers 0-9, one for one, and a clear key for restoring the default values.

A user mode key 503 is the key for selecting one of the power saving modes, such as the standby mode in which the image forming apparatus A is kept turned on without being used for actual image formation. It is also the key for setting the default values for various functions, as will be described later with reference to FIG. 6. A start key 504 is the key to be pressed to activate the copying function or scanning function of the image forming apparatus A. The stop key 505 is the key to be pressed when it is wanted to interrupt the job which is being carried out with the use of the copying, printing, or scanning function of the image forming apparatus A.

A power source key 506 for software is the key to be used when it is wanted to eliminate each of the loads from the motors or the like of the image forming apparatus A while keeping active the CPU, network, etc. A power saving mode key 507 is the key to be pressed by a user to carry out the temperature control sequence (which will be described later with reference to FIG. 6) with the use of the circuit shown in FIG. 1, according to the temperature level (amount of reduction in power consumption) in the power saving mode selected by a user to control the fixing apparatus 135 in power saving. A reset key 508 is the key for resetting to default values the values set through the display portion 501, etc., for controlling the various functions of the image forming apparatus A.

The control panel 505 makes it possible for a user to use the printer 100 of the image forming apparatus A.

Figure 6:
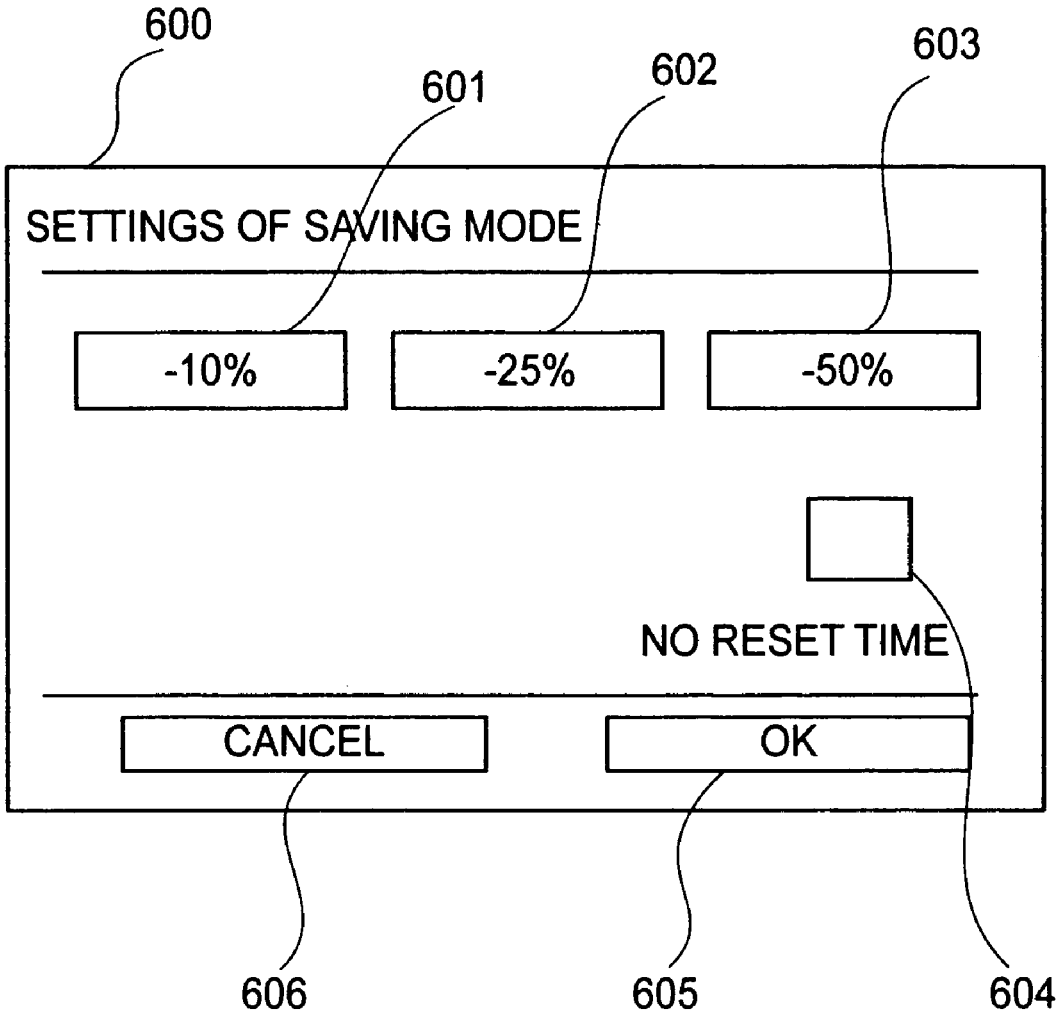
FIG. 6 is a drawing of the window for selecting a power saving mode, in the first embodiment.

The image forming apparatus A in this embodiment is designed so that as a user presses the user mode key 503 of the control panel 500 shown in FIG. 5, the power saving mode window 600 with selection keys appears on the display 501. FIG. 6 shows the power saving mode window 600 which has been made to appear by pressing the power saving mode key 503.

The power saving mode window 600 is usable to set the amount by which the power consumption of the fixing device, more specifically, the fixation heater, is desired to be reduced in the standby mode. More specifically, the power saving mode window 600 offers multiple power saving modes different in the amount of power consumption reduction, as shown in FIG. 6, to allow a user to choose one of the displayed power saving modes and set it.

For example, if a user desires one of the power saving modes in which the power consumption reduction ratio is in the range of −10%-−50%, or the power saving mode in which the printer 100 on standby requires virtually no time to become ready for image formation, but the power consumption reduction ratio is 0%, the user is to press the power consumption reduction keys 601-603, or key 604, and then, to press the OK key 605 to set the printer 100 to the selected power saving mode. The set power saving mode can be cancelled by pressing a cancel key 606.

Figure 7:
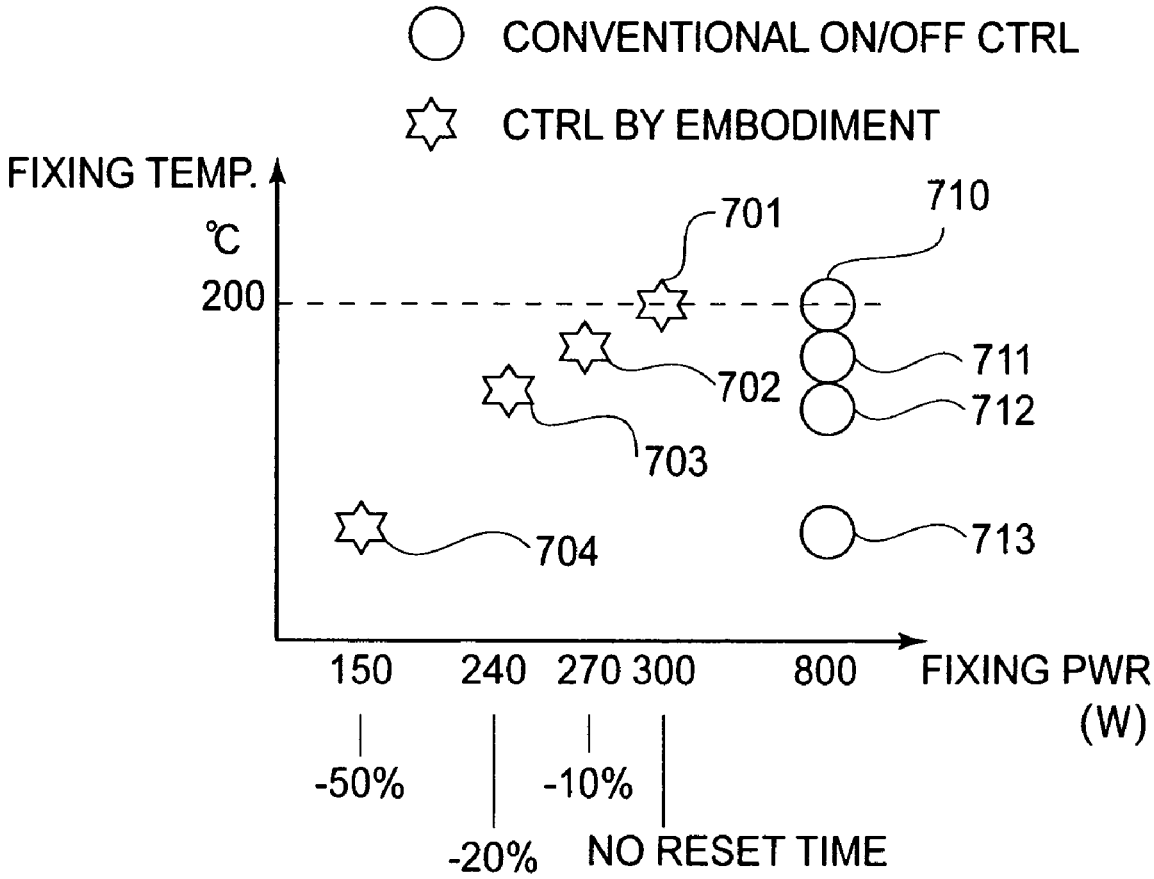
FIG. 7 is a diagram showing the difference between the power saving mode in this embodiment, and the power saving mode in accordance with the prior art.

FIG. 7 is a diagram showing the difference between the power saving mode in this embodiment and that in accordance with the prior art, in terms of the relationship between the target temperature level and the amount of power consumed by the fixation heater.

The employment of the controlling means having the voltage conversion circuit IC1 shown in FIG. 1 makes it possible to output such a direction current voltage as shown in FIG. 4(*c*). Therefore, it makes possible to heat the fixation heater 203 (H1) in order to keep the surface temperature of the heating roller 201 at one of the target temperature levels 701-704, with the use of the amount of power consumable by the fixation heater 203, that is, the amount of power used by the method, in accordance with the prior art, for keeping the surface temperature of the heating roller at the selected target temperature level.

FIG. 8(*a*) is a temperature control table for the power saving mode in accordance with the prior art, in which the power supply to the fixation heater 203 is repeatedly turned on and off, and FIG. 8(*b*) is a temperature control table for the power saving mode, in this embodiment, in which the power supply is controlled in accordance with the present invention.

In the case of the power saving mode in accordance with the prior art, in which the power supply is repeatedly turned on and off, if the key 604 of the power saving mode window 600 of the control panel 500, which is for choosing the "zero wait" mode, has been pressed, that is, when the printer 100 is in the "no wait" mode, the ID of the power saving mode is 0, and the target fixation temperature level is 200° C.

When the ID of the power saving mode is 0, the selected power saving mode is the "zero wait" power saving mode. However, the temperature control is the same as that carried out when the image forming apparatus in the normal standby mode, which is not one of the power saving modes.

When the power consumption reduction rate is "−10%", the ID is 1, and the target temperature level while in the power saving mode is 175° C. Similarly, when the power consumption reduction rate is "−20%", the ID is 2, and the target temperature level while in the power saving mode is 150° C. Further, when the power consumption reduction rate is "−50%", the ID is 3, and the target temperature level while in the power saving mode is 120° C. In the case of the temperature control in accordance with the prior art, that is, the temperature control of the On/Off type, the fixation heater 203 (H1) is kept on until the temperature of the heating roller reaches the set target temperature level, and then, it is turned off as the temperature of the heating roller reaches the set target temperature level.

In comparison, in the case of the power saving mode in this embodiment, in which the power supply is controlled in accordance with the present invention, when the printer 100 is in the "no wait" mode, which is selectable by pressing the key 604 of the power saving mode window 600 of the control panel 500, that is, the key for selecting the "no wait" mode, the ID of the power saving mode is 0, and the level of the voltage applied to the fixation heater 203 (H1) is Vc1, which means that the power consumption by the fixation heater 203 is 300 W.

When the ID is 0, that is, when the printer 100 is in the "no wait" mode, the level of the voltage applied to the fixation heater 203 (H1) is the same as that applied to the fixation heater 203 (H1) when the image forming apparatus A is on standby without being in the power saving mode.

When the power consumption reduction rate is "−10%";, the ID is 1, and the level of the voltage applied to the fixation heater 203 (H1) is Vc2, and the amount of the power consumption is 270 W. Similarly, when the power consumption reduction rate is "−20%", the ID is 2, and the level of the voltage applied to the fixation heater 203 (H1) is Vc3, and the amount of the power consumption is 240 W. Further, when the power consumption reduction rate is "−50%", the ID is 3, and the level of the voltage applied to the fixation heater 203 (H1) is Vc4, and the amount of the power consumption is 150 V. In the case of the power saving mode in this embodiment, the fixation heater 203 (H1) is kept on by applying voltage, the level of which is in accordance with the selected power saving mode.

In this embodiment, the main assembly control circuit IC2 controls the voltage supplied from the voltage conversion circuit IC1 (circuit for driving fixation heater) according to the selected power saving mode. Therefore, as long as the resistance of the fixation heater 203 (H1) remains roughly constant, controlling the voltage applied to the fixation heater 203 (H1) is just as effective to control the amount of power consumption by the fixation heater 203 (H1) as a means dedicated to controlling the amount of power consumption of the fixation heater 203 (H1).

Figure 9:
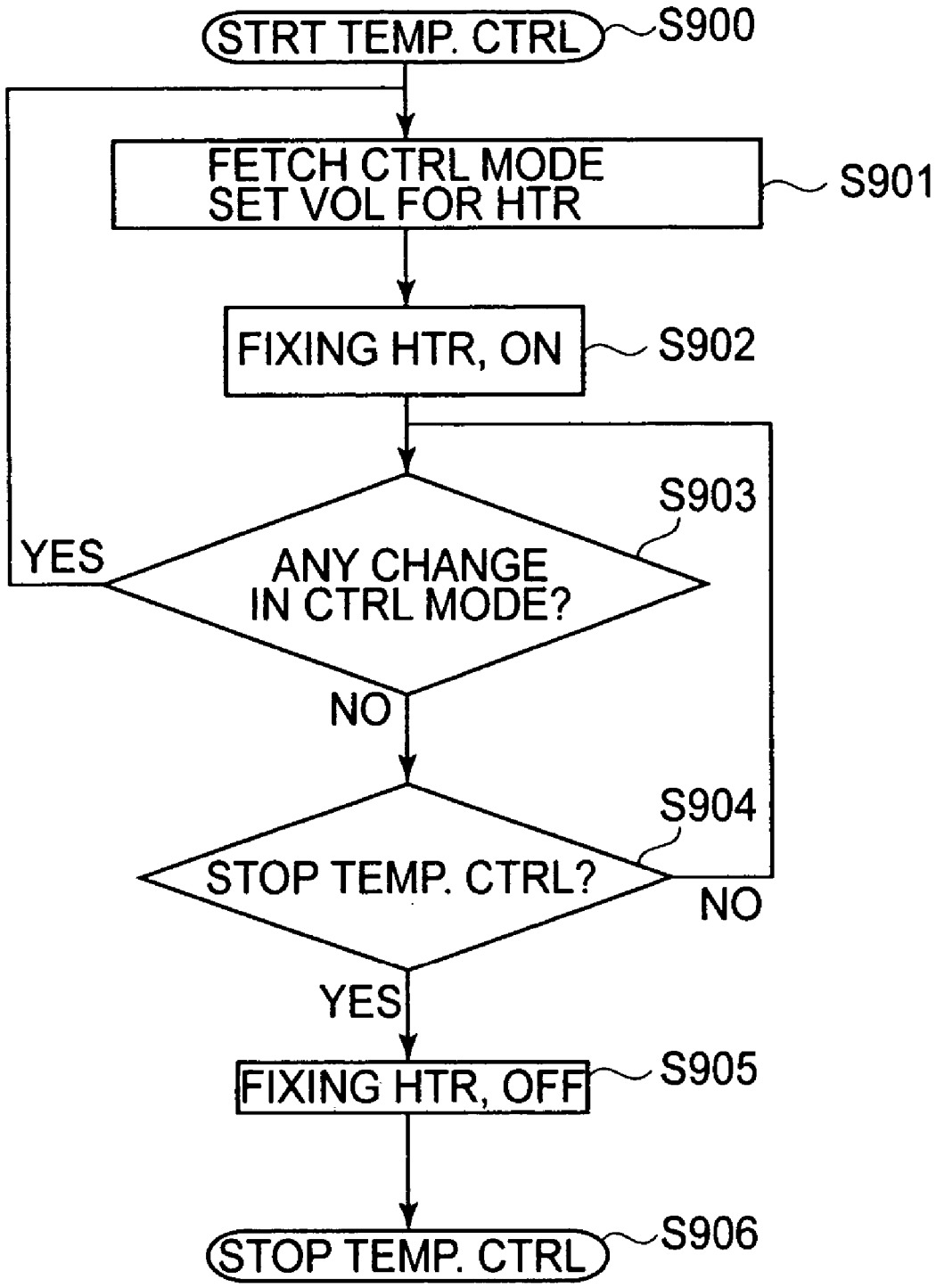
FIG. 9 is a flowchart of the temperature control of the fixing apparatus in the first embodiment of the present invention.

FIG. 9 is a flowchart of the sequence for controlling the power consumption of the fixation heater 203 (H1) while keeping the fixation heater 203 (H1) turned on, based on the above described embodiment of the present invention.

First, the image forming apparatus A is turned on, and the maximum amount of power is continuously supplied to the fixation heater 203 (H1) until the surface temperature of the heating roller 201 is raised by the fixation heater 203 (H1) to the standby level (200° C. in this embodiment). As soon as the surface temperature of the heating roller 201 reaches the standby level, the main assembly control circuit IC2 as a controlling means begins the temperature control for standby period (S900).

In S901, the main assembly control circuit IC2 obtains the temperature control ID by detecting the selected temperature control mode. At the point immediately after the starting of the temperature control in S900, the temperature control for the standby period is being carried out. Therefore, the power saving mode is the same as the "no wait" mode, and therefore, 0 is obtained as the ID. Because the obtained ID is 0, the base voltage level is set to Vc1 with reference to the temperature control table in FIG. 8(*b*). The main assembly control circuit IC2 outputs a voltage control signal which controls the voltage conversion circuit IC1 shown in FIG. 1 so that the level of the voltage applied to the fixation heater 203 (H1) becomes Vc1.

In S902, the main assembly control circuit IC2 controls the voltage conversion circuit IC1 in response to the fixation heater control signal, turning on the fixation heater 203 (H1). That is, the fixation heater 203 (H1) is turned on by the application of the voltage, the level of which is Vc1, and the power consumption is 300 W. Thus, while the image forming apparatus A is on standby, the fixation heat 203 (H1) continues to heat the heating roller 201 while consuming 300 W of power.

In S903, it is determined whether or not the temperature control mode has been changed; it is determined whether or not a signal has been sent from the control panel circuit IC3 to indicate the pressing of the power saving mode key 507, or whether or not the length of the time measured by the main assembly control circuit IC2 is greater than a value set for automatically entering the low power consumption mode if the length of the time measured by the main assembly control circuit IC2 exceeds the value.

If it is determined in S903 that the power saving mode key 507 has been pressed, or the length of time the image forming apparatus A has been in the normal standby mode has exceeded the value to be referenced to determine whether or not the mode in which the image forming apparatus A is operating is to be switched from the normal standby mode to the power saving mode, it is determined that the temperature mode has been switched. Then, the sequence reverts to S901, in which it is determined which temperature control mode has just been selected, and the ID therefor is obtained. On the other hand, if it is determined in S903 that the power saving mode key has not been pressed, and the abovementioned length of time the image forming apparatus A has been in the normal standby mode is less than the abovementioned preset value, the sequence advances to S904, in which it is determined whether or not the temperature control has been interrupted for another reason or reasons.

As an example of other reasons, it is possible that the front door of the main assembly of the image forming apparatus A has been opened by an operator. In such a case, the voltage application to the fixation heater 203 (H1) is stopped for the improvement of operational efficiency, and as the main assembly control circuit IC2 detects this stoppage, the temperature control is stopped. Further, the temperature control is also interrupted if the power source key 506 is pressed and the signal from the operational panel circuit IC3 is detected.

If it is determined in S904 that the temperature control has not been interrupted, the sequence reverts to S903, in which it is determined whether or not the temperature control mode selection has been changed. On the other hand, if it is determined in S904 that the temperature control has been interrupted, the sequence advances to S905.

In S905, the main assembly control circuit IC2 outputs a fixation heater control signal in order to turn off the power supply to the fixation heater 203 (H1) by controlling the voltage conversion circuit IC1.

Then, in S906, the process for stopping the temperature control is carried out, and the temperature control is not carried out until the temperature control is restarted in S900. It is when the front door of the main assembly of the image forming apparatus A is closed by a user, or the power source key 506 or the like of the control panel 500 is pressed again that the temperature control is restarted.

As described above, according to the method, in this embodiment, for controlling the fixing apparatus, the direct current voltage supplied to the fixation heater is controlled in order to achieve the selected power consumption reduction ratio in the power saving mode. Therefore, it is possible to keep the fixation heater continuously turned on while keeping constant the amount of the power consumed by the fixation heater.

Therefore, it is possible to accurately calculate the amount of power consumed by the fixing apparatus while the image forming apparatus A is in the power saving mode. Further, in the power saving mode in this embodiment, the fixation heater is kept on. Therefore, the aforementioned circuit for suppressing the rush current is unnecessary, or all that is necessary is an inexpensive protective circuit. In other words, the complicated temperature control is unnecessary. Therefore, it is possible to provide an image forming apparatus which is not only lower in cost than an image forming apparatus in accordance with the prior art, but also, does not cause the flickering of fluorescent lights or the like while it is in the power saving mode.

Incidentally, a halogen heater is made up of a heat generating member and a sealed glass tube filled with halogen gas. Thus, if a halogen heater is not supplied with 100% of the power for which the heater is designed, the glass tube is likely to turn black, which drastically shortens the service life of the halogen light. Therefore, the employment of a halogen heater as a heating means in combination with the temperature control sequence in this embodiment sometimes drastically reduces the service life of the halogen heater.

In comparison, a carbon heater is made up of a heating member formed of carbon or the like substance, and the heating member itself is an electrically resistive element. Therefore, reducing the amount of power supplied to a carbon heater, from the maximum amount does not reduce the service life of the carbon heater. In other words, a carbon heater is preferable to a halogen heater in that the former does not suffer from the above described problem from which the latter suffers, that is, the problem that the employment of the temperature control in this embodiment in combination with a halogen heater substantially reduces the service life of the halogen heater.

Embodiment 2

Next, the temperature control in the second embodiment will be described. The image forming apparatus and fixing apparatus, to which the temperature control in this embodiment is applicable with good results, are virtually identical in gist to the image forming apparatus and fixing apparatus in the first embodiment, and therefore, will not be described.

Described first will be the method for keeping constant the surface temperature of the heating roller, regardless of the ambience of an image forming apparatus, with use of the temperature detection element TH1 of the fixing apparatus 135, while keeping a fixation heater 203 (H1) turned on.

Figure 10:
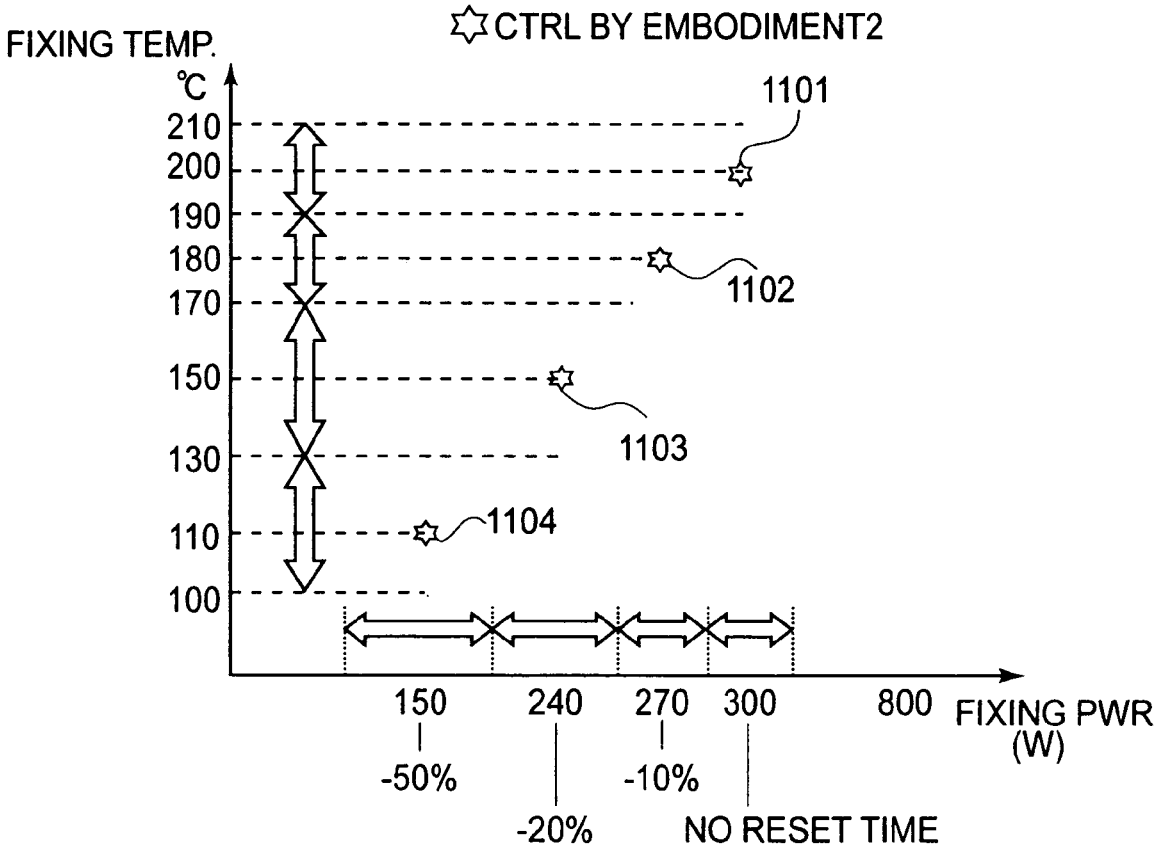
FIG. 10 is the diagram showing the control of the power supply to the fixation heater, in the second embodiment of the present invention.

Also in this embodiment, such voltages as those shown in FIG. 4 can be outputted by using a controlling means comprising a voltage conversion circuit IC1 shown in FIG. 1, in order to keep the surface temperature of the heating roller or the like at one of the target temperature levels 701-704 shown in FIG. 7. More specifically, a direct current voltage in accordance with the power consumption reduction ratio of the selected power saving mode is continuously applied to the fixation heater 203 (H1) to heat it. Further, based on the results of the temperature detection by the temperature detection element TH1, the amount of the power consumption (proportional to amount of direct current voltage applied to fixation heater), which corresponds to the power consumption reduction ratio, is varied within a predetermined range. FIG. 10 is a graph showing the results of such a temperature control.

Referring to FIG. 10, one of the target temperatures 1101-1104, which correspond, one for one, to four temperature control modes, which are "no wait" mode, "−10%" mode, "−20%" mode, and "−50%" mode, is set as one of the temperature control modes (power saving modes) is selected. The temperature control in the second embodiment is similar to that in the first embodiment in that the temperature of the heating roller is controlled by controlling the amount of power supplied to the fixation heater, as shown in FIGS. 7, 8(*b*), and 9.

The amount by which heat radiates from the heating roller varies depending on the ambience of the image forming apparatus A. Therefore, continuously supplying the fixing apparatus 135 with the same amount of power cannot keep constant the surface temperature of the heating roller at a predetermined level. These target temperature levels 1101-1104 are for dealing with this type of situation.

Thus, the main assembly control circuit IC2 (as means for setting power consumption range) sets a range for the amount of power to be supplied from the voltage conversion circuit, with reference to such a table as the one (which will be described later) shown in FIG. 11, based on the selected power saving mode. In addition, the main assembly control circuit IC2 (as means for setting target range for temperature control) also sets a target range for the surface temperature of the heating roller 201, with reference to such a table as the one (which will be described later) shown in FIG. 11, based on the selected power saving mode.

Then, the main assembly control circuit IC2 varies the amount of power supplied to the fixation heater 203 (H1) (magnitude of direct current voltage supplied to fixation heater), in response to the surface temperature level of the heating roller 201 detected by the temperature detection element TH1, within the range set by the main assembly control circuit IC2.

For example, in the case of the "no wait" power saving mode which corresponds to the target temperature 1101, the target temperature itself is 200° C. However, if the ambience of the image forming apparatus A is cold, continuously applying to the fixation heater 203 (H1) voltage Vc1, which supplies the fixation heater 203 (H1) with 300 W of power, cannot keep the surface temperature of the heating roller 201 at the target temperature of 200° C. because of heat radiation. On the other hand, if the ambience of the image forming apparatus A is warm, continuously applying to the fixation heater 203 (H1) voltage Vc1 sometimes makes the surface temperature of the heating roller 201 exceed 200° C., because the warm ambience impedes heat radiation.

Thus, the temperature control is given more latitude. That is, the temperature control is given a target temperature range, the upper and lower limits of which are 210° C. and 190° C., instead of a rigid target level of 200° C., as shown in FIG. 10. Further, the amount of the power supplied to the fixation heater is rendered variable between 280 W and 320 W, instead of being fixed at 300 W. In other words, each of the power saving modes are given more latitude in terms of the power consumed by the fixing apparatus, that is, the magnitude of the direct current voltage applied to the fixation heater.

Similarly, in the case of the "−10%" power saving mode, the target temperature 1102 is set to roughly 180° C., that is, a temperature range, the highest and lowest temperature levels of which are 190° C. and 170° C., respectively. Correspondingly, the amount of power consumed by the fixing apparatus while the image forming apparatus A is in the power saving mode is set to a value in a range, the largest and smallest values of which are 280 W and 255 W, respectively.

In the case of the "−20%" power saving mode, the target temperature 1103 is set to roughly 150° C., that is, a temperature range, the highest and lowest temperature levels of which are 170° C. and 130° C., respectively. Correspondingly, the amount of power consumed by the fixing apparatus while the image forming apparatus A is in this power saving mode is set to a value in a range, the largest and smallest values of which are 255 W and 200 W, respectively.

In the case of the "−50%" power saving mode, the target temperature 1104 is set to roughly 110° C., that is, a range, the highest and lowest temperature levels of which are 130° C. and 100° C., respectively. Correspondingly, the amount of power consumed by the fixing apparatus while the image forming apparatus A is in this power saving mode is set to a value in a range, the largest and smallest values of which are 200 W and 130 W, respectively.

With employment of this temperature controlling method, even if the ambient temperature of the fixing apparatus varies due to the changes in the ambience of the image forming apparatus A and/or the operation conditions of the image forming apparatus A, the amount by which power is consumed by the fixation heater 203 (H1) in one of the power saving modes can be precisely controlled while keeping the surface temperature of the heating roller within a predetermined range. Further, it makes it possible to keep the fixation heater 203 (H1) continuously turned on while optimally controlling the surface temperature of the heating roller. Therefore, it makes it possible to virtually eliminate the flickering of the fluorescent lights or the like attributable to the temperature control of the fixing apparatus.

FIG. 11 is a temperature control table for the power saving modes in this embodiment, in which the surface temperature of the heating roller is controlled by controlling the amount of power supplied to the heating member. The table is used in the same manner as the table shown in FIG. 8(*b*). That is, when the image forming apparatus A is in the "no wait" mode, which is selectable by pressing the "no wait" key 604 of the power saving mode window 600 of the control panel 500, the ID of the power saving mode is 0, and the base level of the voltage applied to the fixation heater 203 (H1) is Vc1, which causes the fixation heater 203 (H1) to consume 300 W of power.

The magnitude of the voltage applied to the fixation heater 203 (H1) when the power saving mode ID is 0, that is, when the image forming apparatus A is in the "no wait" mode, is equal to that of the voltage applied to the fixation heater 203 (H1) when the image forming apparatus A is simply on standby, that is, in the normal standby mode in which power is not saved. In this mode, the target temperature level, that is, the temperature level at which the temperature level detected by the temperature detection element TH1 is intended to be kept constant by the temperature control is 200° C.

It is possible that while voltage Vc1 is continuously applied to the fixation heater 203 (H1) to keep constant the surface temperature of the heating roller at a predetermined level, the temperature of the heating roller will fluctuate due to the changes in the ambience of the image forming apparatus A. In this embodiment, therefore, two temperature levels, 210° C. as the upper limit and 190° C. as the lower limit, are set as the temperature levels at which the voltage applied to the fixation heater is switched.

Further, the highest and lowest levels of the voltage applied to the fixation heater 203 (H1) are set to Vmax1 and Vmin1, respectively. Therefore, as the temperature level detected by the temperature detection element TH1 reaches 210° C., or the upper limit, the level of the voltage applied to the fixation heater 203 (H1) is switched to Vmin1. Similarly, as the temperature level detected by the temperature detection element TH1 falls below 190° C., or the lower limit, the level of the voltage applied to the fixation heater 203 (H1) is switched to Vmax1. Thus, in this embodiment, even in a situation in which, due to the changes in the ambience of the image forming apparatus A, continuously applying a voltage with a predetermined level to the fixation heater 203 is insufficient to keep the surface temperature of the heating roller at a desired level, the surface temperature of the heating roller can be kept within a proper temperature range, by controlling the voltage applied to the fixation heater 203 (H1).

Similarly, in the "−10%" power saving mode, the ID of the power saving mode is 1, the basic level of the voltage applied to the fixation heater 203 (H1) is Vc2, the base amount of power consumed by the fixation heater 203 (H1) is 270 W, the target temperature level is 180° C., the upper temperature limit is 190° C., the lower temperature limit is 170° C., the upper voltage limit is Vmax2, the lower voltage limit is Vmin2, the upper power consumption limit is 280 W, and the lower power consumption limit is 255 W.

In the "−20%" power saving mode, the ID of the power saving mode is 2, the base level of the voltage applied to the fixation heater 203 (H1) is Vc3, the base amount of power consumed by the fixation heater 203 (H1) is 240 W, the target temperature level is 150° C., the upper temperature limit is 170° C., the lower temperature limit is 130° C., the upper voltage limit is Vmax3, the lower voltage limit is Vmin3, the upper power consumption limit is 255 W, and the lower power consumption limit is 200 W.

In the "−10%" power saving mode, the ID of the power saving mode is 3, the base level of the voltage applied to the fixation heater 203 (H1) is Vc4, the base amount of power consumed by the fixation heater 203 (H1) is 150 W, the target temperature level is 110° C., the upper temperature limit is 130° C., the lower temperature limit is 100° C., the upper voltage limit is Vmax4, the lower voltage limit is Vmin4, the upper power consumption limit is 200 W, and the lower power consumption limit is 130 W.

In this embodiment, the fixation heater 203 (H1) is controlled in temperature by the base voltage level, upper limit of the voltage level, and lower limit of the voltage level in the selected power saving mode, so that the temperature level detected by the temperature detection element TH1 remains within the range which includes the target temperature level, while the fixation heat 203 (H1) is kept turned on.

More concretely, the main assembly control circuit IC2 as a controlling means varies the amount of power supplied to the fixation heater 203, in response to the surface temperature of the heating roller 201, within the predetermined range (280 W-320 W). Further, while the image forming apparatus A is on standby, the main assembly control circuit IC2 carries out such a control that the fixation heater 203 heats the heating roller 201 so that the surface temperature of the heating roller 201 remains within the target temperature range (190° C.-210° C.), and so that the amount of power consumed by the fixation heater 203 remains within the above described range.

In this embodiment, it is as it is determined that the surface temperature of the heating roller 201 reaches the upper or lower temperature limit, that the level of the voltage applied to the fixation heater 203 is switched. More specifically, if the surface temperature of the heating roller 201 exceeds 210° C., that is, the upper limit of the target temperature range for the surface temperature of the heating roller 201, the main assembly control circuit IC2 switches the level of the voltage applied to the fixation roller 203 to Vmin1, that is, the lower voltage level limit, so that the amount of power supplied to the fixation heater 203 falls to 280 W, that is, the lower limit of the preset power consumption range. On the other hand, if the surface temperature of the heating roller 201 falls below 190° C., that is, the lower limit of the target temperature range for the surface temperature of the heating roller 201, the main assembly control circuit IC2 switches the level of the voltage applied to the fixation roller 203 to Vmax1, that is, the upper voltage level limit, so that the amount of power supplied to the fixation heater 203 reaches 320 W, that is, the upper limit of the preset power consumption range. In other words, the surface temperature of the heating roller 201 can be kept within the target temperature range with the use of a simple control.

It is preferable that the magnitude of the voltage applied to the fixation heater 203 is set based on the detected surface temperature of the heating roller 201, with reference to the table which shows the predetermined relation (function) between the level to which the target temperature is switched, and the amount to which the power consumption is to be set according to the level to which the target temperature is to be switched. The employment of this method makes it possible to more precisely reduce the power consumption of the fixation heater.

Figure 12:
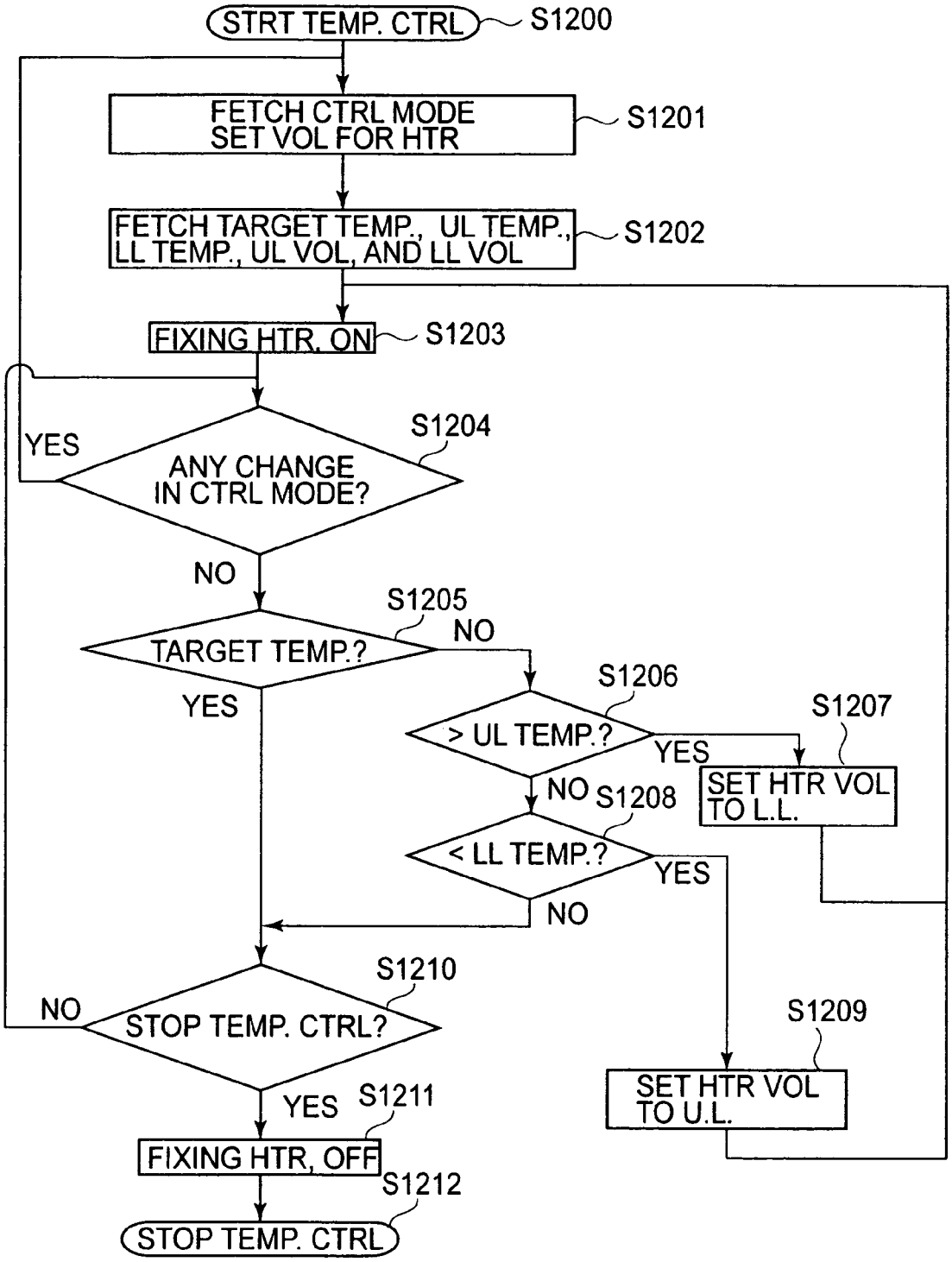
FIG. 12 is a flowchart of the control of the fixing apparatus in the second embodiment of the present invention.

Given in FIG. 12 is a flowchart of the control sequence, in this embodiment, for controlling the surface temperature of the heating roller of the fixing apparatus 135, with the use of the temperature detection element TH1 which detects the surface temperature of the heating roller, while keeping the fixation heater 203 (H1) turned on.

In this embodiment, the image forming apparatus A is provided with the voltage conversion circuit IC1 capable of outputting voltage of any value within the predetermined range. However, for the simplification of description, the control sequence will be described using only the base voltage value, upper voltage limit value, and lower voltage limit value.

As the surface temperature of the heating roller 201 is increased by the fixation heater 203 (H1) to the standby level (200° C. in this embodiment) after the power source of the image forming apparatus A is turned on, the main assembly control circuit IC2 as a controlling means begins the temperature control sequence for the standby mode, in S1200.

In S1201, the main assembly control circuit IC2 identifies the selected temperature control mode, and obtains the ID thereof. If it is immediately after the beginning of the temperature control sequence in S1200, the temperature control mode is the same as that for the standby mode. In other words, the power saving mode is the same as the "no wait" power saving mode, and therefore, 0 is obtained as the ID. Since the obtained ID is 0, the base voltage level is set to Vc1 with reference to the temperature control table in FIG. 10.

In S1202, the main assembly control circuit IC2 obtains the target temperature level, upper temperature limit, lower temperature limit, upper voltage level limit (Vmax1), and lower voltage level limit (Vmin1), in order to control the surface temperature of the heating roller.

In S1203, the main assembly control circuit IC2 outputs a fixation heater control signal to control the voltage conversion circuit IC1 in order to begin applying a voltage with the preset value to the fixation heater 203 (H1), that is, in order to turn on the fixation heater 203 (H1). If the fixation heater 203 (H1) is already on, only the value of the voltage being applied to the fixation heater 203 is affected by the voltage conversion circuit IC1.

In S1204, whether or not there has been a change in the temperature control mode is determined by determining whether or not a communication signal, which indicates that the power saving mode key 507 of the control panel 500 has been pressed, has been sent from the control panel circuit IC3, or whether or not the length of time measured by the main assembly control circuit IC2 has exceeded a value preset as the reference for automatically triggering a predetermined power saving mode.

If it is determined in S1204 that the power saving mode key 507 has been pressed, or the length of time measured by the main assembly control circuit IC2 has exceeded the above-mentioned value preset as the reference for automatically triggering the predetermined power saving mode, it is determined that there has been a change in the temperature control mode, and the control sequence returns to S1201, in which the new temperature control mode is identified, and the ID of the new temperature control mode is obtained. On the other hand, if it is determined in S1204 that the power saving mode key 507 has not been pressed, and the length of time measured by the main assembly control circuit IC2 has not exceeded the aforementioned value preset as the reference for automatically triggering the predetermined power saving mode, the control sequence moves to S1205, in which it is confirmed whether or not the temperature control sequence has been interrupted because of another reason or reasons.

In S1205, it is confirmed whether or not the temperature level obtained by the main assembly control circuit IC2 through the fixation heater temperature detection element TH1 is the same as the target temperature level (200° C. if power saving mode ID is 0) obtained in S1202. If it is not, the control sequence moves to S1206, and if it is, the control sequence moves to S1210.

In S1206, it is determined whether or not the temperature level detected by the temperature detection element TH1 is higher than the upper temperature limit. If it is greater than the upper temperature limit, the main assembly control circuit IC2 outputs, in S1207, a voltage control signal to set the magnitude of the voltage outputted from the voltage conversion circuit IC1 to the lower limit value. Then, the control sequence returns to S1203, in which the main assembly control circuit IC2 switches the magnitude of the voltage applied to the fixation heater to Vmin, that is, the lower voltage level limit.

If it is determined in S1206 that the temperature level detected by the temperature detection element TH1 is not higher than the upper limit, S1208 is taken, in which it is determined whether or not the temperature level detected by the temperature detection element TH1 is below the lower limit. If it is determined that the temperature is below the lower limit, the main assembly control circuit 1C2 outputs, in S1209, a voltage control signal to set the magnitude of the voltage outputted from the voltage conversion circuit IC1, to Vmax, that is, the upper limit. Then, S1203 is taken, in which the main assembly control circuit IC2 switches the magnitude of the voltage applied to the fixation heater to Vmin, that is, the upper voltage level limit.

If it is determined in S1208 that the temperature level detected by the temperature detection element TH1 is not lower than the lower limit, S1210 is taken In S1210, it is confirmed whether or not the temperature control sequence has been interrupted because of another reason or reasons. For example, it is possible that the front door of the main assembly of the image forming apparatus A has been opened by an operator as was mentioned in the description of the first embodiment. In such a case, the voltage application to the fixation heater 203 (H1) is interrupted for operational efficiency, and the main assembly control circuit IC2 stops the temperature control sequence as it detects this interruption of the voltage application to the fixation heater 203 (H1). Further, the temperature control sequence is also stopped as the main assembly control circuit IC2 detects the communication signal outputted from the control panel circuit IC3 by the pressing of the power key 506 of the control panel 500.

If it is determined in S1210 that the temperature control sequence has not been interrupted, S1204 is taken, in which it is determined whether or not the temperature control mode has been switched. If it is determined in S1210 that the temperature control sequence has been interrupted, S1211 is taken.

In S1211, the main assembly control circuit IC2 outputs a fixation heater control signal to cause the voltage conversion circuit IC1 to stop supplying the fixation heater 203 (H1) with power.

Then, the process for terminating the temperature control sequence is carried out in S1212, to prevent the temperature control sequence from being carried out until it is started again in S1200. As for when the interrupted temperature control sequence is restarted, or the temperature control sequence is started from the beginning, it is when the front door of the main assembly of the image forming apparatus A is closed by a user, or the power source key 506 or the like of the control panel 500 is pressed again, respectively.

As described above, the temperature control of the fixing apparatus, in this embodiment, makes it possible to control the surface temperature of the heating roller or the like while keeping the fixation heater continuously turned on. Therefore, it makes it possible to accurately calculate the amount of power consumed to accurately control the surface temperature of the heating roller or the like, regardless of the ambience of an image forming apparatus. Further, it makes unnecessary a protective circuit for suppressing rush current, or even if it does not make the protective circuit unnecessary, the one it requires is not an expensive one. Further, it is not complicated, and can realize a power saving mode which does not cause fluorescent lights or the like to flicker.

As described above, according to the present invention embodied in the form of the preceding embodiments, it is possible to inexpensively realize a power saving mode which does not cause fluorescent lights or the like to flicker, and also, to precisely reduce the amount of power consumed by the fixing apparatus.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 205847/2004 filed Jul. 13, 2004 which is hereby incorporated by reference.

What is claimed is:

1. An image forming apparatus comprising:

an image forming device for forming a toner image on a recording material;

a fixing device for heat fixing the toner image on the recording material;

a carbon heater for heating said fixing device; and a controller for controlling a supply voltage to said carbon heater, said controller including a conversion circuit for converting an AC voltage inputted from a commercial voltage source to a DC voltage, wherein in a stand-by mode in which electric energy consumption of said carbon heater is reduced, said controller continuously supplies the DC voltage to said carbon heater during a heating process without interruption and without switching on and off.

2. An apparatus according to claim 1, further comprising an operating panel for setting an amount of reduction of the electric energy consumption in said stand-by mode, wherein said controller, in said stand-by mode, continuously supplies the DC voltage set in accordance with the amount of reduction of the electric energy consumption during the heating process without interruption.

3. An apparatus according to claim 2, wherein said controller, in said stand-by mode, supplies the DC voltage during the heating process so as to decrease the DC voltage with increase of the amount of reduction of the electric energy consumption.

4. An apparatus according to claim 2, further comprising a detector which detects a temperature of said fixing device, wherein said controller, in said stand-by mode, changes the DC voltage in accordance with an output of said detector.

5. An apparatus according to claim 2, wherein said controller, in said stand-by mode, changes the DC voltage in accordance with an ambient condition.

* * * * *